US008584904B2

(12) United States Patent
Coleman

(10) Patent No.: US 8,584,904 B2
(45) Date of Patent: Nov. 19, 2013

(54) LIQUID SOAP DISPENSER FOR DISPENSING A MIXTURE OF A DISH CLEANING LIQUID SOAP AND WATER

(76) Inventor: James Sylvester Coleman, New York, NY (US)

( * ) Notice: Subject to any disclaimer, the term of this patent is extended or adjusted under 35 U.S.C. 154(b) by 118 days.

(21) Appl. No.: 13/226,262

(22) Filed: Sep. 6, 2011

(65) Prior Publication Data

US 2013/0056496 A1 Mar. 7, 2013

(51) Int. Cl.
*B67D 7/06* (2010.01)

(52) U.S. Cl.
USPC ..... 222/185.1; 22/1; 22/108; 22/181.1; 22/505; 22/509; 22/511; 22/518

(58) Field of Classification Search
USPC ..... 222/1, 108, 192, 181.1–181.3, 185.1, 222/186, 505, 508, 511, 517–518, 556; 141/86, 88
See application file for complete search history.

(56) References Cited

U.S. PATENT DOCUMENTS 3,107,828 A * 10/1963 Costakos ..... 222/438
3,344,958 A * 10/1967 Kaanehe ..... 222/181.2
4,493,440 A * 1/1985 von Buelow et al. ..... 222/109
5,139,172 A * 8/1992 Brown ..... 222/181.2
5,248,067 A * 9/1993 Garcia ..... 222/181.2
5,305,927 A * 4/1994 Caveza ..... 222/185.1
5,507,414 A * 4/1996 Ong ..... 222/108
5,649,643 A * 7/1997 Ridgeway ..... 222/105
5,678,733 A * 10/1997 Ong ..... 222/108
5,857,596 A * 1/1999 Lee ..... 222/509

* cited by examiner

*Primary Examiner* — Frederick C Nicolas
(74) *Attorney, Agent, or Firm* — Oakwood Law Group, LLP; Jie Tan

(57) ABSTRACT

A liquid dish cleaning fluid dispenser having a reservoir adapted to receive liquid dish cleaning fluid, a dispensing port located at the bottom of the reservoir and a manually operated cantilevered member pivotally coupled to a plastic support base located below the reservoir and attached to a base member which supports the reservoir. A release lever is located at the end of the cantilevered member for moving downward the cantilevered member and a valve member is located in the cantilevered member which engages the dispensing port in the reservoir to allow cleaning fluid to flow out of the reservoir when the release lever is manually urged to moved downward. The plastic manually operated cantilevered member springs back to it's initial up position to close the valve member to prevent fluid from flowing out of the reservoir when the release lever is no longer manually urged to move downward.

12 Claims, 5 Drawing Sheets

LIQUID SOAP DISPENSER FOR DISPENSING A MIXTURE OF A DISH CLEANING LIQUID SOAP AND WATER

BACKGROUND OF THE INVENTION

1. Field of the Invention

The present invention relates generally to a liquid soap dispenser and more specifically to a liquid soap dispenser that dispenses a mixture of a liquid soap and water that is used to clean dishes, pots and pans.

2. Description of Related Art

Apparatus for dispensing liquid soap for cleaning dishes is known in the prior art. More specifically, by way of example, U.S. Pat. No. 6,736,562 to Whitmore discloses a device for storing and applying liquid to a cleaning implement, including an application module which may be slidably engaged to either a countertop reservoir module, or an installed reservoir module.

U.S. Pat. No. 6,604,879 to Gueret discloses an applicator which is engaged with a container containing a liquid, and an application member which is capable of conveying the liquid to the application member. The applicator further includes a lid configured to removably cover the applicator member by engaging with the support. In a closed end of the lid there is a solid cake or powder which can be loaded onto the application face which can be put in contact with a surface to apply the combined first and second products.

U.S. Pat. No. 6,309,124 to Gueret discloses a dispenser wherein preferably a cosmetic or pharmaceutical liquid or gel is pumped from a reservoir into an application chamber. The chamber is sealed by screwing or snapping on a removable cap. The cap comprises the applicator itself. Positioning of the cap relative to the application chamber is required for dispensing liquid or gel to the applicator. This configuration is not preferable for application of liquid dishwashing soap to a kitchen sponge.

U.S. Pat. No. 6,280,111 to Armer, et al. discloses a countertop dispenser wherein a lever may be actuated to pump liquid soap into an application chamber. Excess soap drains from the application chamber through a plethora of holes. At rest, application chamber is entirely above liquid level in reservoir and exposed to air.

U.S. Pat. No. 6,270,275 to Martz discloses a sponge storage and disinfecting device encloses a kitchen or bathroom sponge when not in use. The device has a housing with a hinged lid to cover the sponge container tray, and with a liquid reservoir behind the tray for dispensing a cleaning and disinfecting solution into the sponge when the sponge is pushed down in the tray. In a preferred embodiment the sponge rests on a platform supported resiliently in the tray, and pushing down of the sponge and tray opens a valve door to admit disinfecting liquid from the storage reservoir into the tray.

U.S. Pat. No. 5,507,414 to Ong discloses a sponge support that is formed atop the liquid detergent receptacle. The sponge support may include a mesh screen and is hinged relative to the base to rotate about a horizontal axis. The sponge support may be moved between a lowered, horizontal disposition directly above the liquid detergent receptacle and a raised disposition out of vertical alignment between the dispensing orifice and the liquid detergent receptacle. The sponge support provides a convenient place for storing a kitchen sponge, and also allows the sponge to dry out.

U.S. Pat. No. 4,831,681 to Puder discloses a device for supporting a sponge which has a container filled with liquid, a sponge supporting plate in the container, and a resilient member that urging the supporting plate with the sponge away from the liquid and depressable by a user into the liquid to moisten the sponge.

SUMMARY OF THE INVENTION

In an exemplary embodiment of the present invention, there is disclosed a liquid dish cleaning fluid dispenser comprising;

a reservoir adapted to receive liquid dish cleaning fluid;

a dispensing port located at the bottom of the reservoir;

a manually operated cantilevered member pivotally coupled to a support base made of plastic sandwiched between the reservoir and a base member which supports the reservoir;

a release lever located at the end of the manually operated cantilevered member for moving downward the cantilevered member;

a valve member attached to the manually operated cantilevered member which engages the dispensing port in the reservoir to selectively allow cleaning fluid to flow out of the reservoir when the release lever is manually urged to move downward; and a pan located under the valve member coupled to the base member;

wherein the plastic manually operated cantilevered member springs back to it's initial up position to close the valve member to prevent fluid from flowing out of the reservoir when the release lever is no longer manually urged to move downward.

The more important features of the invention have thus been outlined in order that the more detailed description that follows may be better understood and in order that the present contribution to the art may better be appreciated. Additional features of the invention will be described hereinafter and will form the subject matter of the claims that follow.

Before explaining at least one embodiment of the invention in detail, it is to be understood that the invention is not limited in its application to the details of construction and the arrangements of the components set forth in the following description or illustrated in the drawings. The invention is capable of other embodiments and of being practiced and carried out in various ways. Also it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

The foregoing has outlined, rather broadly, the preferred feature of the present invention so that those skilled in the art may better understand the detailed description of the invention that follows. Additional features of the invention will be described hereinafter that form the subject of the claims of the invention. Those skilled in the art should appreciate that they can readily use the disclosed conception and specific embodiment as a basis for designing or modifying other structures for carrying out the same purposes of the present invention and that such other structures do not depart from the spirit and scope of the invention in its broadest form.

BRIEF DESCRIPTION OF THE DRAWINGS

Other aspects, features, and advantages of the present invention will become more fully apparent from the following detailed description, the appended claim, and the accompanying drawings in which similar elements are given similar reference numerals.

DESCRIPTION OF THE PREFERRED EMBODIMENT

Figure 1:
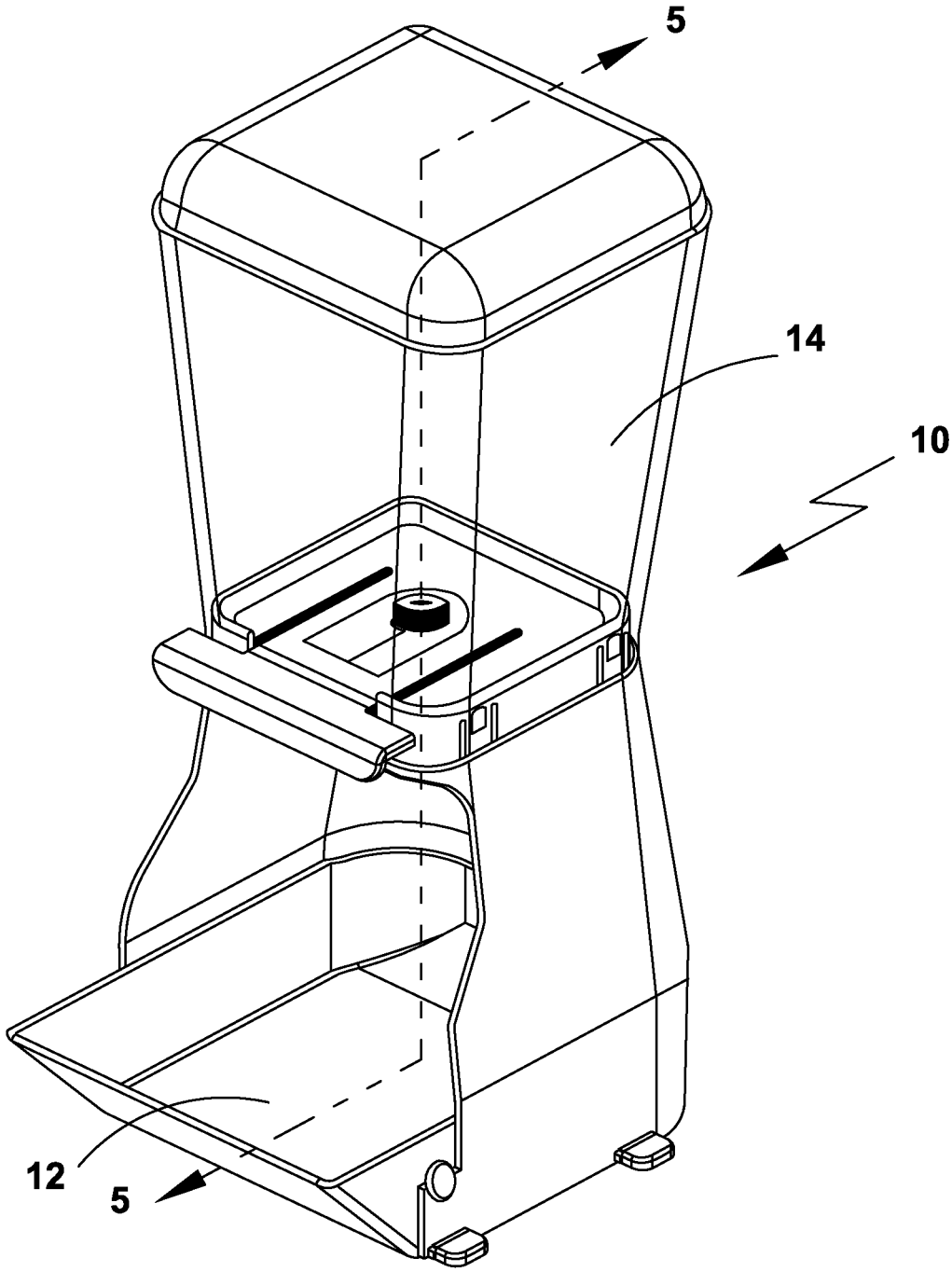
FIG. 1 is a perspective view of an embodiment of the dish soap dispenser in accordance with the principles of the invention.

Referring to FIG. 1, there is disclosed a perspective view of a liquid soap dispenser 10 for dispensing liquid dish soap or a mixture of a dish cleaning liquid soap and water into a pan 12 located below a refill reservoir 14 in accordance with the principles of the invention. The pan 12 of the dish soap dispenser is adapted to hold a scrub pad (not shown) for cleaning dishes, or scrubbing pots and pans and a liquid cleaning fluid such as a liquid soap which may be premixed with and diluted with water that is supplied to the pan from the reservoir 14 located above the pan. The liquid soap reservoir 14 is located directly above the pan 12 and contains a dispensing port which is selectively opened and closed by a manually operated release lever which, when urged downward causes a stopper to be pulled away from an opening on the bottom of reservoir 14 thus allowing a small amount of the mixture of liquid soap and water located in the reservoir to fall down into the pan.

Figure 2:
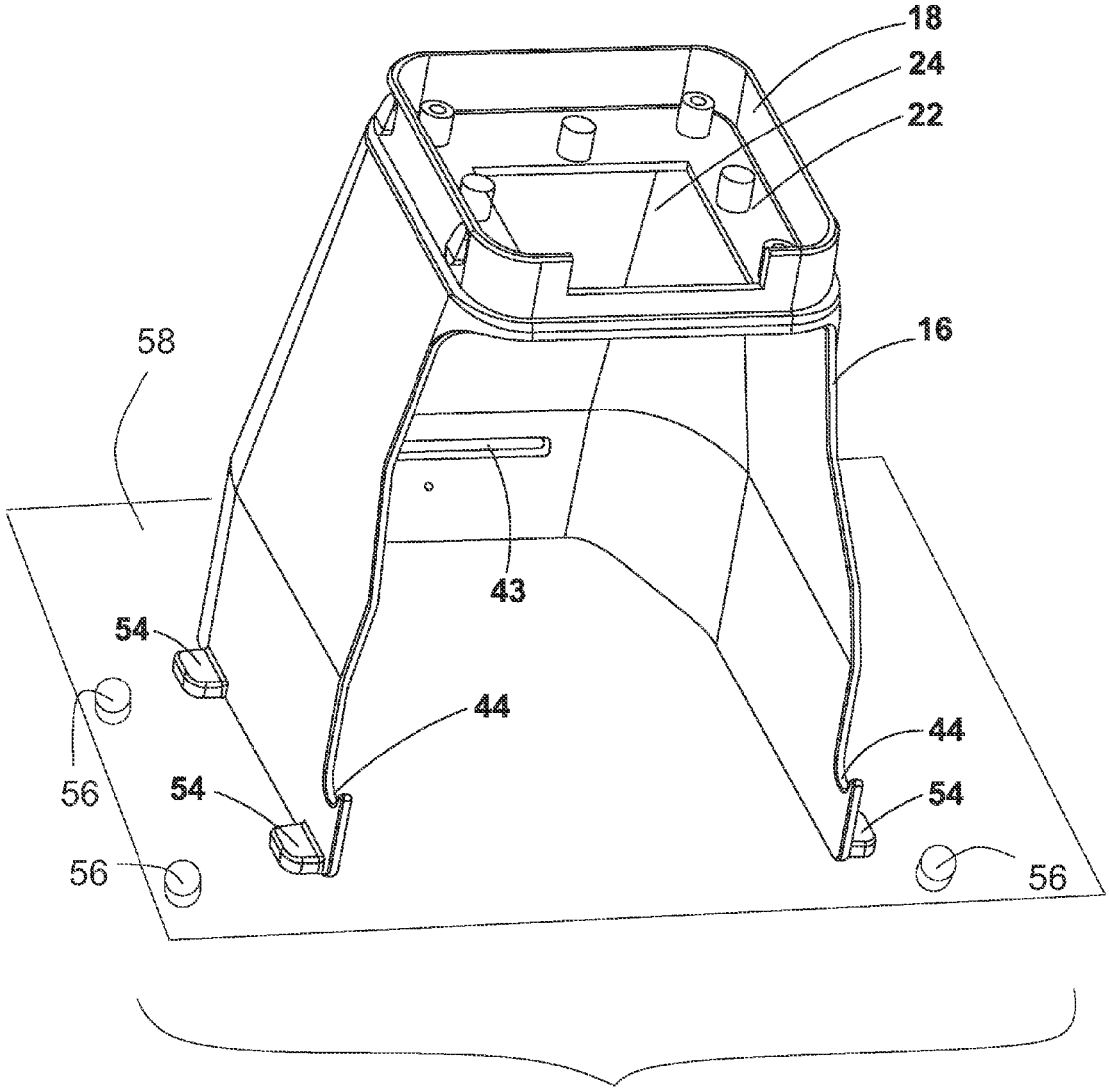
FIG. 2 is a front perspective view of the base of the embodiment of the dish soap dispenser of FIG. 1.

Referring to FIG. 2, there is shown a front perspective view of the base 16 of the embodiment of the dish soap dispenser of FIG. 1. The base may be made of a single piece of rigid or semi rigid plastic which may be clear or colored and which includes at it's top a walled chamber 18 open at the top and a floor 22 having an opening 24 for dispensing the liquid soap from reservoir 14 and a plastic support base. The plastic support base 26 supports a cantilevered member 28 that includes a valve member 30 and a hand or finger operated valve release lever 34 more fully depicted in FIG. 3. The plastic support base is removably attached to the floor 22 and the valve member is sandwiched between the support base and the bottom of the liquid soap reservoir. The end of the manually operated valve release lever is depressed to allow the liquid mixture of soap and water to flow out of the reservoir when moved down.

Figure 3:
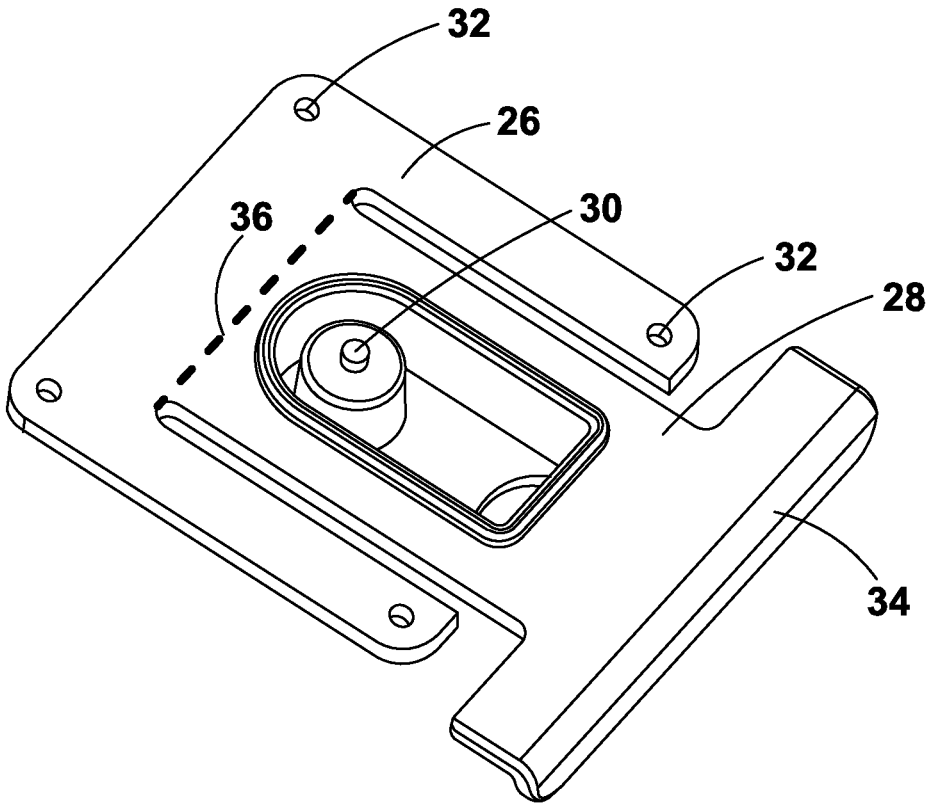
FIG. 3 is a top perspective view of the plastic cantilever valve member which is located at the bottom of the liquid soap reservoir.

Referring to FIG. 3, there is shown a top perspective view of the plastic support base 26 which supports a manually operated cantilevered member 28 that includes a valve member 30 which engages the dispensing port located at the bottom of the soap dish reservoir. The plastic support base has four openings 32 which are positioned to engage four plastic projections that protrude from the floor 22. The support base 26 supports a manually operated cantilevere member 28 that includes a valve member 30 and a hand or finger operated valve release lever 34 which is located at the end of the cantilevered member. The cantilevered member pivots (about the dotted line 36 on the plastic support base The support base and manually operated cantilevered member are of a semi rigid plastic material where, when the manually operated cantilevered member 28 is released after it has been moved down to allow fluid to flow out of the reservoir, automatically springs back to it's initial up position to close the valve and prevent fluid from flowing out of the reservoir. The valve release lever which is located at the end of the manually operated cantilevered member projects out from the walled chamber. The valve member 30 may include a flat washer or an O ring disclosed in FIG. 5 to provide a positive seal to prevent fluid from leaking through the valve when it is closed.

Figure 4:
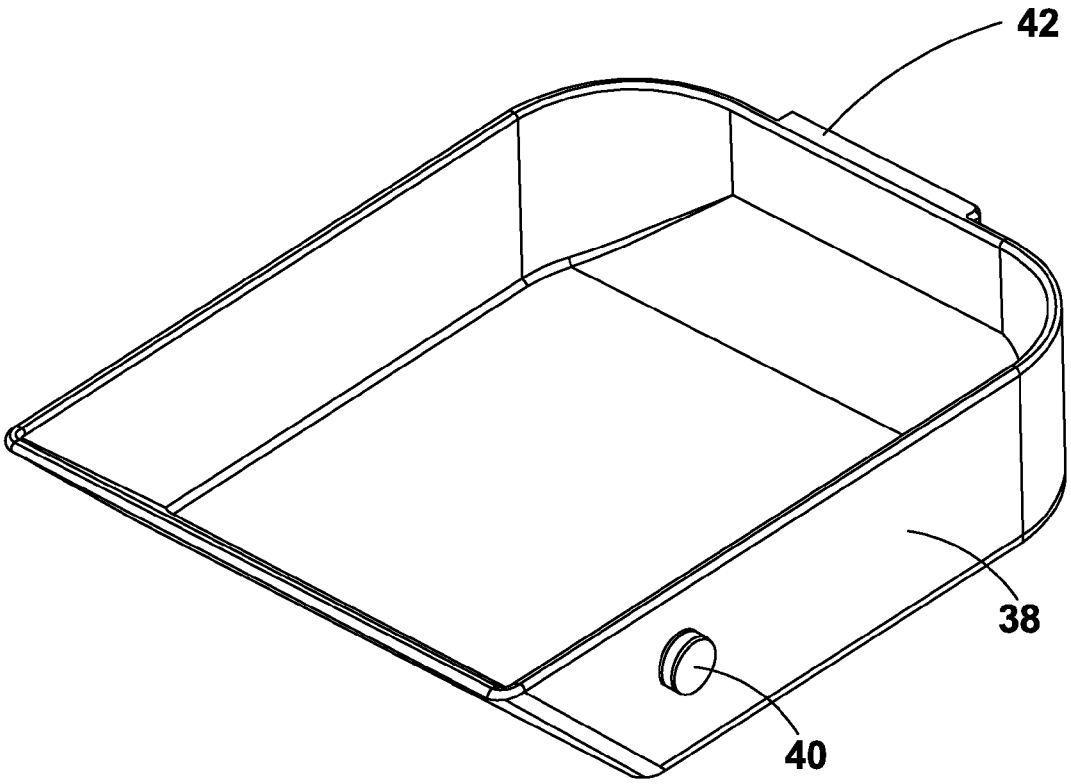
FIG. 4 is a perspective view of the pan of the embodiment of the dish soap dispenser of FIG. 1.
Figure 5:
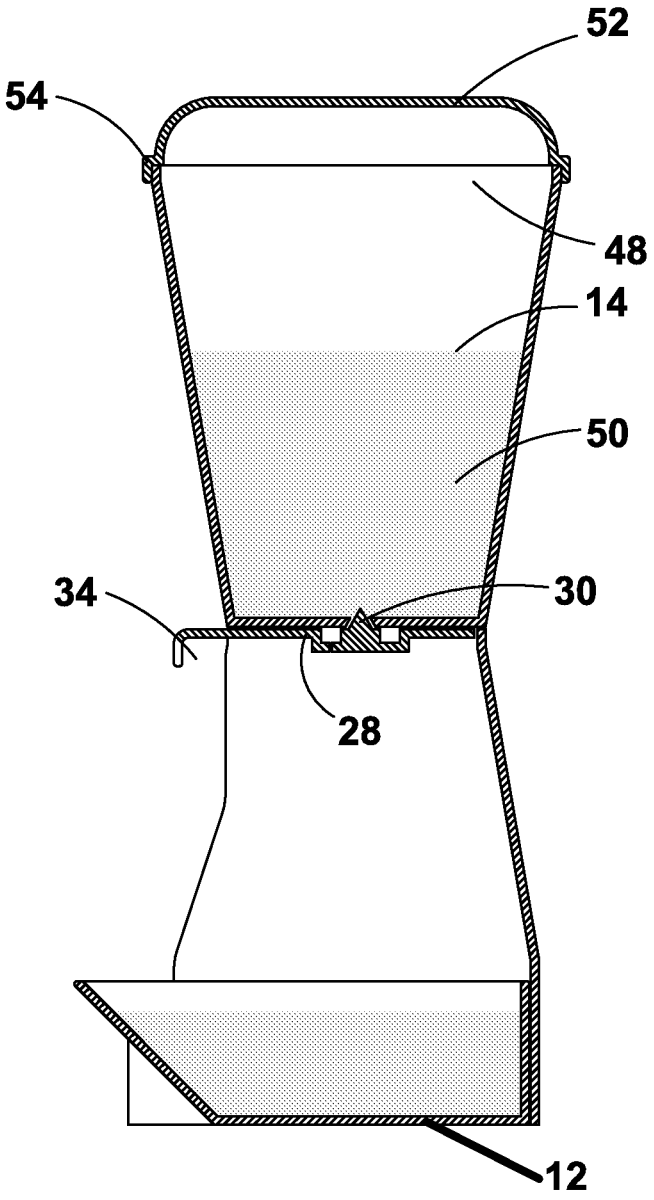
FIG. 5 is an elevational view taken along the line 5-5 of FIG. 1.

FIGS. 4 and 5 shows a view of the pan 38 of the embodiment of the dish soap dispenser of FIG. 1 which may be removably attached to the base. Referring to FIGS. 2 and 4, the pan 38, when removably attached to the base has two cylindrical projections 40, one on each side of the pan and a rectangular shaped flange 42 which protrudes from the rear of the pan. The flange 42 is adapted to fit into slot 43 in the back wall of the base 16, see FIG. 2, and the cylindrical projections are adapted to fit into the J shaped hooks 44 in the side walls of the base 16.

Referring to FIG. 5 there is shown a sectional elevational view taken along the line 5-5 of the embodiment of FIG. 1. The dish soap dispensing pan 38 and liquid soap reservoir 14 are molded from a plastic that is impervious to both water and soap. The top of the reservoir has a full size removable lid for receiving the liquid soap and water mixture 50.

Located at the bottom of the reservoir 14 is a soap and water dispensing port which cooperates with a shaped valve seat and a shaped plunger where the outer circumference of the plunger may have a soft rubber washer or an O ring to provide a leak resistant seal. The bottom of the plunger is connected to the valve member on the manually operated cantilevered member 28 which, when manually moved down, allows the soap and water mixture in the reservoir to flow out of the dispensing port.

Referring to FIG. 2, small rubber or soft plastic suction cups 56, may be attached to the bottom of the horizontal projections 54 to allow the dispenser to adhere to the counter top near the kitchen sink 58 or directly to the kitchen sink.

To use the dish washing soap dispenser, a user first places the apparatus near or on the kitchen sink, and then removes the top 52 and fills the reservoir with an amount of liquid soap dish cleaner and water where the amount of soap in the mixture is between one and one hundred percent.

After adding the mixture of dish washing soap and water to the reservoir and when the soapy water is desired for cleaning dishes, or for any other purpose, the user simply pushes down either continuously or intermittently on the end of the lever to open the valve to the reservoir which allows soapy water from the reservoir to flow down through the valve to the pan below. When the downward force on the lever 34 is removed, the manually operated cantilevered member springs back to it's initial up position which insures that the valve is closed and the flow of soapy water trough the valve to the pan below is stopped.

A sponge or scouring pad is placed or dipped in the pan and wetted with the soapy water. The user may now use the soapy sponge or scouring pad to clean dishes, wipe counted tops, clean pots and pans or perform any other cleaning task in a kitchen.

While there have been shown and described and pointed out the fundamental novel features of the invention as applied to the preferred embodiments, it will be understood that the foregoing is considered as illustrative only of the principles of the invention and not intended to be exhaustive or to limit the invention to the precise forms disclosed. Obvious modifications or variations are possible in light of the above teachings. The embodiments discussed were chosen and described to provide the best illustration of the principles of the invention and its practical application to enable one of ordinary skill in the art to utilize the invention in various embodiments and with various modifications as are suited to the particular use contemplated All such modifications and variations are within the scope of the invention as determined by the appended claims when interpreted in accordance with the breadth to which they are entitled.

What is claimed is:

1. A liquid dish cleaning fluid dispenser comprising;

a reservoir adapted to receive liquid dish cleaning fluid;

a dispensing port located at the bottom of the reservoir;

a manually operated cantilevered member pivotally coupled to a support base made of plastic sandwiched between the reservoir and a base member which supports the reservoir;

a release lever located at the end of the manually operated cantilevered member for moving downward the cantilevered member;

a valve member attached to the manually operated cantilevered member which engages the dispensing port in the reservoir to selectively allow the cleaning fluid to flow out of the reservoir when the release lever is manually urged to move downward; and a pan located under the valve member coupled to the base member;

wherein the plastic manually operated cantilevered member springs back to the initial up position to close the valve member to prevent the fluid from flowing out of the reservoir when the release lever is no longer manually urged to move downward.

2. The liquid cleaning fluid dispenser of claim 1 wherein the liquid dish cleaning fluid in the reservoir is liquid soap or a mixture of liquid soap and water for cleaning dishes.

3. The liquid cleaning fluid dispenser of claim 2 wherein the mixture of liquid soap and water for cleaning dishes is between one and one hundred percent soap.

4. The liquid cleaning fluid dispenser of claim 2 wherein the dispenser and pan is made of a plastic that is impervious to water or soap.

5. The liquid cleaning fluid dispenser of claim 1 wherein the support base rests on a sink top or a kitchen counter top adjacent to a kitchen sink.

6. The liquid cleaning fluid dispenser of claim 5 wherein the base member is removably attached to the kitchen counter top adjacent to the kitchen sink or to the kitchen sink with suction cups.

7. A method of dispensing a liquid dish cleaning fluid comprises;

providing a reservoir adapted to receive liquid dish cleaning fluid;

locating a dispensing port at the bottom of the reservoir;

pivotally coupling a manually operated cantilevered member to a support base made of plastic which is sandwiched between the reservoir and a base member which supports the reservoir;

providing a release lever at the end of the manually operated cantilevered member for moving downward the cantilevered member;

locating a valve member attached to manually operated cantilevered member which engages the dispensing port in the reservoir to selectively allow the cleaning fluid to flow out of the reservoir when the release lever is manually urged to moved downward; and locating a pan under the valve member and coupled to the base member;

wherein the plastic manually operated cantilevered member springs back to the initial up position to close the valve member to prevent the fluid from flowing out of the reservoir when the release lever is no longer manually urged to move downward.

8. The method of dispensing liquid dish cleaning fluid of claim 7 wherein the liquid dish cleaning fluid in the reservoir is liquid soap or a mixture of liquid soap and water for cleaning dishes.

9. The method of dispensing liquid dish cleaning fluid of claim 8 wherein the mixture of liquid soap and water for cleaning dishes is between one and one hundred percent soap.

10. The method of dispensing liquid dish cleaning fluid of claim 7 wherein the dispenser and pan is made of a plastic that is impervious to water or soap.

11. The method of dispensing liquid dish cleaning fluid of claim 7 wherein the base member rests on or is removably adhered to a kitchen counter top adjacent to a kitchen sink or to a kitchen sink.

12. The method of dispensing liquid dish cleaning fluid of claim 11 wherein the support base is attached to the kitchen counter top adjacent to the kitchen sink or to the kitchen sink with suction cups.

* * * * *